United States Patent [19]

Maire et al.

[11] 4,398,832

[45] Aug. 16, 1983

[54] MULTIFUNCTION TIMEPIECE

[75] Inventors: Aurèle Maire, La Chaux-de-Fonds; Jean-Georges Michel, Neuchatel; Jean-Claude Robert-Grandpierre, Colombier, all of Switzerland

[73] Assignee: Compagnie des Montres Longines Francillon SA, Saint-Imier, Switzerland

[21] Appl. No.: 347,576

[22] Filed: Feb. 10, 1982

[30] Foreign Application Priority Data

Feb. 16, 1981 [CH] Switzerland ..... 994/81

[51] Int. Cl.³ ..... G04B 19/00

[52] U.S. Cl. ..... 368/76; 368/66; 368/80; 368/85; 368/220

[58] Field of Search ..... 318/66, 76, 80, 85, 318/86, 87, 217, 218, 219, 220, 71, 110, 107, 111, 113

[56] References Cited

U.S. PATENT DOCUMENTS

| | | | |
|---|---|---|---|
| 3,662,535 | 5/1972 | Hedrick et al. | 368/112 |
| 3,884,035 | 5/1975 | Jeannet et al. | 368/110 X |
| 4,223,522 | 9/1980 | Nomura et al. | 368/66 |
| 4,259,736 | 3/1981 | Berney | 368/62 |
| 4,259,737 | 3/1981 | Berney | 368/76 X |
| 4,314,146 | 2/1982 | Berney | 377/112 |

FOREIGN PATENT DOCUMENTS

| | | |
|---|---|---|
| 27250 | 11/1981 | European Pat. Off. . |
| 2809256 | 9/1978 | Fed. Rep. of Germany . |
| 2394840 | 2/1979 | France . |
| 2436377 | 11/1981 | France . |
| 1540555 | 12/1977 | United Kingdom . |

*Primary Examiner*—Ulysses Weldon

*Attorney, Agent, or Firm*—Wender, Murase & White

[57] ABSTRACT

The timepiece comprises a first motor (8) driving the seconds hand (s) independently from the other hands indicating the minutes and the hours which are driven by a second motor (4). A logic circuit (5) is capable of controlling the first motor (8) in response to the actuation of control elements (C,S1, S2) external to the electronic circuit of the timepiece or by means (6) internal to this electronic circuit and in response to time base signals delivered by a frequency divider (2) so that the seconds hand indicates informations which are different from the ones for the display of which it is normally provided.

12 Claims, 5 Drawing Figures

OSCILLATOR
FREQUENCY DIVIDER
CONTROL CIRCUIT
MOTOR
DIAL
COUNTER OF SEC.
CONTROL CIRCUIT
MOTOR
LOGIC CIRCUIT
COMPARATOR
REV. COUNTER
DETECTOR
DELAY CIRCUIT

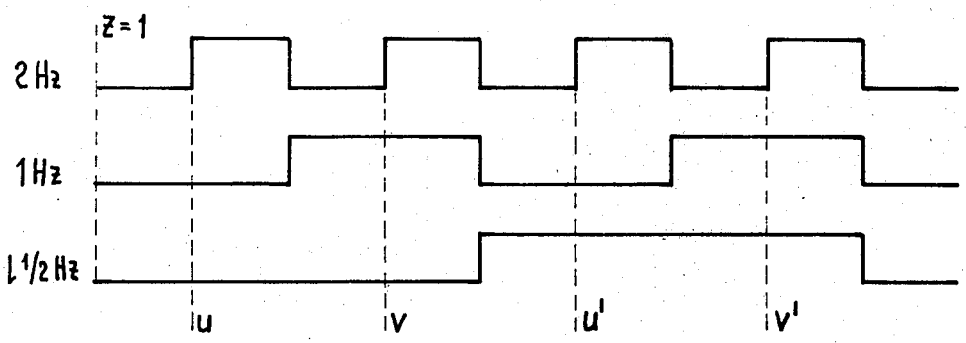
FIG. 3
FIG. 4
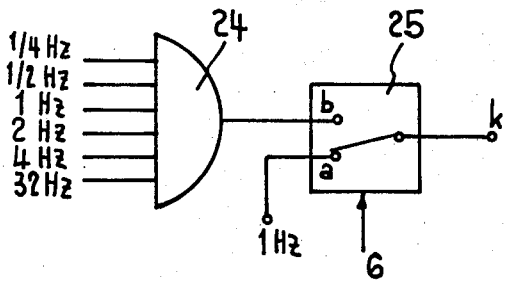
FIG. 5
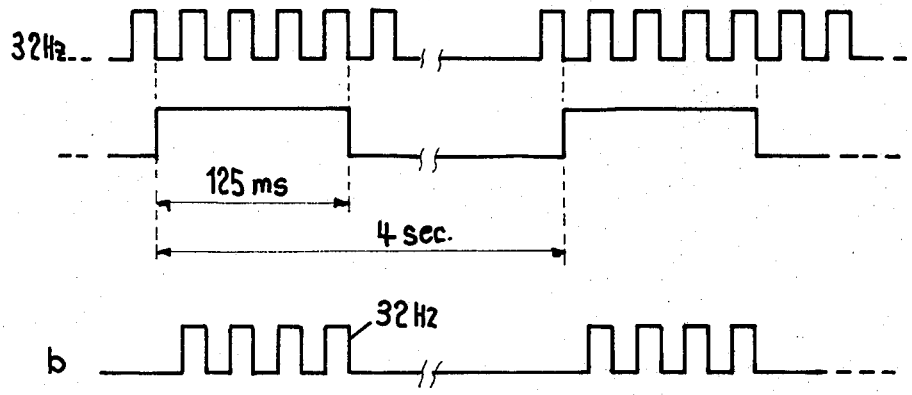

MULTIFUNCTION TIMEPIECE

BACKGROUND OF THE INVENTION

The present invention relates to a multifunction timepiece comprising a first and a second stepping motor, said first motor driving the seconds hand and said second motor driving other display elements, electronic circuits delivering time base signals and control signals of said first and second motors and control elements.

In a conventional electronic timepiece with analog display, the stepping motor normally drives simultaneously all display elements, that is the seconds, minutes and hours hands. Consequently the movements of these hands are linked by fixed gear ratios which do not permit to dissociate the movement of one of the hands relatively to the one of the other hands, however with the exception of the movement of the seconds hand with respect to the one of the minutes and hours hands during the operation of setting of the timepiece.

On the contrary, in an electronic timepiece comprising two motors controled independently and driving separately the seconds hand on the one hand and the minutes and hours hands on the other hand, the movement of the seconds hand is no more rigidly linked to the one of the other hands so that the seconds hand can be utilized independently of the other hands without disturbing the display of the hour and the minute.

In a multifunction timepiece, it is e.g. particularly useful to have means for identifying the functions to be controlled, or in other words, to identify by an adequate indication the function which is selected.

It is an object of the present invention to realize an electronic timepiece in which the seconds hand may be utilized for indicating, in addition of the seconds, other informations different of the seconds of the real time.

SUMMARY OF THE INVENTION

The timepiece according to the invention comprises control means of said first motor for controlling movements and displacements of the seconds hand in response to said time base signals and to said control elements so that the seconds hand indicates informations which are different from the information for the display of which it is normally provided.

The invention will be further described by way of example and with reference to the accompanying drawings.

BRIEF DESCRIPTION OF THE DRAWINGS

FIG. 3 shows a pulse diagram of the signal 1 of FIG. 2, FIG. 4 shows the block diagram of an electronic circuit permitting to control periodically a number of steps of the seconds hand at a frequency greater than 1 Hz, and FIG. 5 shows a pulse diagram of the signal b of FIG. 4.

DESCRIPTION OF THE PREFERRED EMBODIMENTS

Figure 1:
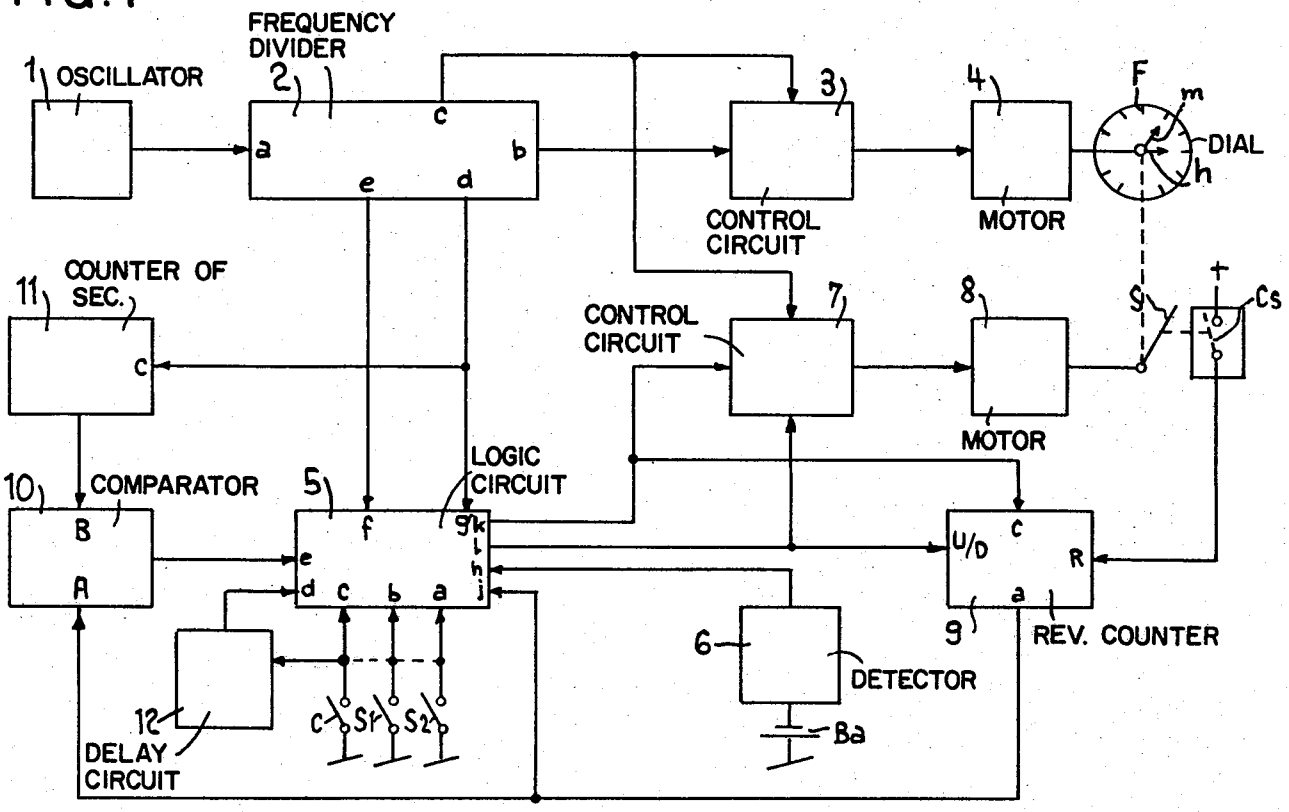
FIG. 1 shows the block diagram of the electronic circuits of a timepiece according to the invention.

The circuit of FIG. 1 comprises an oscillator 1 delivering a frequency of reference to the input a of a frequency divider 2. The frequency divider delivers in its turn on its output b a signal of the minutes for the control circuit 3 of the motor 4 which drives the minutes and hours hands m and h and on its output c a signal determining the duration of the driving pulses of the motor. The frequency divider 2 delivers also on its output d a signal of the seconds and on its output e time base signals applied to a logic circuit 5 capable of driving the seconds hand. In FIG. 1, the time base signals are represented schematically as being delivered on a unique output e of the frequency divider but it is clear that actually they are delivered on a certain number of outputs of the frequency divider. The logic circuit 5 comprises among other a plurality of circuits controlled on the one hand by the time base signals and on the other hand by signals delivered by the control elements which are actuated manually. These control elements are e.g. contacts S1, S2 actuated by push-buttons external to the electronic circuit of the timepiece, or a contact C actuated by the crown of the timepiece. It is further also possible to provide control means of the circuit 5 which are incorporated to the electronic circuit. This is the case for example of a detector 6 of the voltage of the battery Ba which delivers a signal to the circuit 5 when the battery is at the end of its life, its voltage decreasing then under a determined value of reference. The logic circuit 5 delivers signals to the control circuit 7 of the motor 8 driving the seconds hand s independently from the other hands. The circuit 7 drives the motor 8 forward and backward. During the normal operation of the timepiece, that is when the seconds hand indicates effectively the seconds of the real time, the circuit 5 delivers at its output k to the circuit 7 the signal of the seconds delivered to the circuit 5 by the frequency divider 2. On the contrary, when the seconds hand is utilized for indicating the selection of a particular function of the timepiece which is different from the display of the seconds, the circuit 5 delivers to the circuit 7 a signal different from the one of the seconds in response to the time base signals and to the number of the control elements which are actuated and, as the case may be, to the number of actuations exerted on these control elements. The transit of the seconds hand s through the position 60 on the dial of the timepiece is detected either by an electronic counter or by an electromechanical contact Cs on the shaft of the seconds hand. This detection produces the reset to zero of a reversible counter 9 receiving on its clock input c the signal from the output k of the logic circuit 5. The input U/D controlling the counting direction of the counter 9 receives a signal delivered by the output 1 of the circuit 5. The preceding shows that the contents of the reversible counter 9 is always representative of the position of the seconds hand on the dial. This contents which is present at the outputs a of the counter 9 is delivered on the one hand to the inputs j of the logic circuit 5 and on the other hand to the inputs A of a comparator 10. In FIG. 1, the outputs a of the counter 9 and the inputs j and A of the circuit 5 and of the comparator 10 are schematically represented on a unique terminal. The input B of the comparator 10 is connected to the output of a counter of the seconds 11 receiving on its clock input c the signal of the seconds from the output d of the frequency divider 2.

The comparator 10 delivers to the input e of the logic circuit 5 a control signal when the equality of the signals A and B is realized. It delivers also on another line to the input e of the circuit 5 a signal determining the forward or the backward motion of the seconds hand. This signal determines a normal, forward rotation of the seconds hand if the contents of the counter of the seconds 11 is greater than the one of the counter 9 and a backward rotation in the reverse case. A delay circuit 12 controlled by the control elements C, S1 and S2 is connected to the input d of the circuit 5.

Let us examine now the operation of the circuit for different examples in which the seconds hand is utilized for indicating informations different from the seconds of the real time.

The first example relates to the detection of the end of life of the battery Ba. When the voltage of the latter decreases under a determined level the detector 6 delivers a signal to the input h of the logic circuit 5. In response to this signal, the circuit 5 controls e.g. the stop of the seconds hand on a well determined position of the dial, for example the position 30. To this end, and when the timepiece operates previously as a normal timepiece indicating the seconds, minutes and hours of the real time, the circuit 5 compares the contents of the counter 9 which is present on its inputs j with a first fixed internal value of reference corresponding to the position 30 and when the equality between the contents of the counter 9 and the value of reference is obtained, the circuit 5 interrupts definitely the signal on its output k so that the seconds hand remains definitely blocked on the position 30 of the dial. Hence, the user knows that the battery of its timepiece must be changed at an early date.

In the case in which the user desires to change the indication of a time zone it actuates for example the crown of its timepiece. The actuation of the crown closes on the one hand a contact C and permits on the other hand the mechanical driving of the minutes and hours hands. The closing of the contact C controls the delay circuit 12 and delivers a signal to the input c of the logic circuit 5. In response to this signal and to the time base signals, the circuit 5 delivers on its output k pulses having a frequency of repetition greater than 1 Hz for driving rapidly the seconds hand to a fixed mark F on the dial. When the seconds hand arrives in front of the mark F the result of the comparison between the signal of the counter 9 present on the inputs j of the circuit 5 and a second internal value of reference corresponding to the position of the mark F on the dial interrupts the signal at the output k of the circuit 5 and the seconds hand stops in front of the mark F. The delay circuit 12 determines an interval of time, e.g. of 30 seconds, which is imparted to the user for effecting the changing of the indication of the time zone. At the end of this interval of time of 30 seconds the circuit 12 delivers to the input d of the circuit 5 a signal which produces a rapid movement, forward or backward, of the seconds hand until the comparator 10 delivers a signal of equality A=B indicating that the seconds hand is again in a position corresponding to the normal display of the seconds of the real time. From this time, the seconds hand indicates again the seconds of the real time.

The preceding shows that during the operation of changing of the indication of a time zone, the seconds hand is rapidly positioned in front of a mark F designating this operation and that it stops in this position for a determined interval of time during which the user effects the required changing of the indication of the time zone. After the end of this interval of time, the seconds hand comes rapidly to the position corresponding to the normal display of the seconds of the real time and from this instant its movement displays again the seconds as normal.

In an electronic timepiece with a quartz crystal it is possible to effect a correction of the display of the seconds (setting to zero) simultaneously with a correction of the frequency at the output of the frequency divider (setting of the frequency or fine correction) when the error is no greater than ±30 seconds. The selection of this function, for example by means of control elements like S1 and/or S2, may be indicated e.g. by an alternating movement of the seconds hand between the positions 59 and 1 of the dial. In this case and in response to the actuation of the control elements and to the time base signals the circuit 5 delivers at its output k at first a signal for rapidly moving the seconds hand (frequency greater than 1 Hz) and then, when the seconds hand arrives in front of the position 59 of the dial and in response to the equality between the signal on the inputs j of the circuit 5 and a third fixed internal value of reference corresponding to 59, e.g. pulses of 2 Hz producing a movement of the seconds hand twice as fast as normal. Simultaneously, the circuit 5 delivers at its output l a rectangular signal having a period of 2 seconds which controls alternatingly each second the forward and backward motion of the motor 8 and of the reversible counter 9 so that the seconds hand makes 2 steps at each second, during the first second in the forward direction from the position 58 over the position 60 to the position 1 of the dial and during the next second in the backward direction from the position 1 over the position 60 to the position 59 of the dial, and so on. After a certain time determined e.g. by the delay circuit 12, a function of making up for the lost time like the one described in the preceding example is effected and the seconds hand restart working normally.

Figure 2:
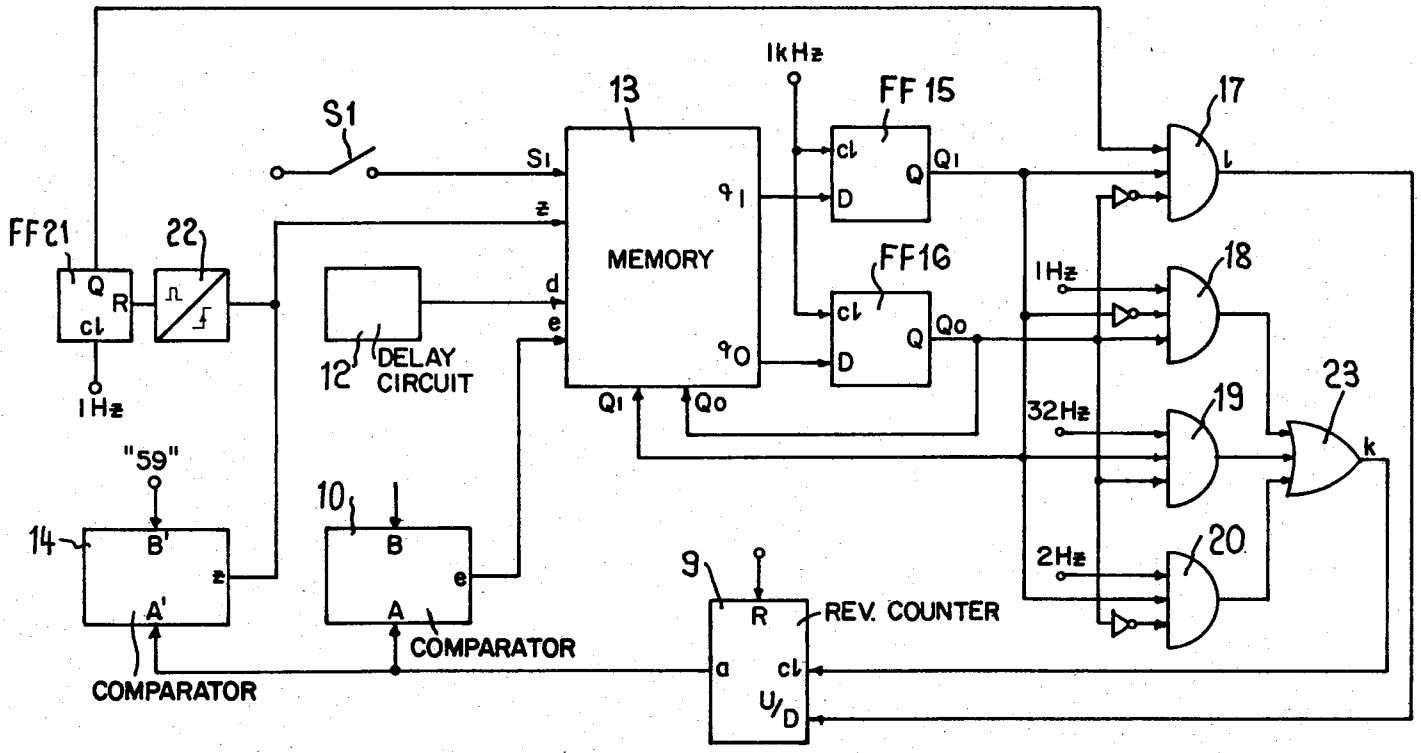
FIG. 2 shows the block diagram of an electronic circuit controlling an alternate forward and backward motion of the seconds hand.

FIG. 2 shows a circuit for controlling the above described motion of the seconds hand during the correction of the display.

In FIG. 2 the elements similar to the ones of FIG. 1 are indicated by the same designations. The other elements are incorporated in the logic circuit 5. The circuit of FIG. 2 comprises a memory 13 e.g. of the ROM-type but which can also be realized with logic gates. The memory 13 has address inputs S1, Z, d, e, Q1 and Qo and it delivers its contents at the output terminals g1 and go. The input S1 is connected to the control element S1, the input Z is connected to the output of an internal comparator 14 receiving on its input A' the contents of the reversible counter 9 on the terminal j of circuit 5 and on its input B' the third value of reference corresponding to "59". The input d of the memory is connected to the output of the delay circuit 12 and the input e is connected to the output of the comparator 10. The input Q1 of the memory 13 is connected to the output of a D-flip-flop FF15 the input D of which is connected to the output q1 of the memory and the clock input of which receiving a signal of 1 kHz delivered by the frequency divider 2. The input Qo of the memory is connected to the output of a D-flip-flop FF16 the D input of which is connected to the output qo of the memory and the clock input of which receiving the signal of 1 kHz. The output Q1 of FF15 is connected to a first input of each of the AND gates 17, 19 and 20 and through an inverter to a first input of the AND gate 18. The output Qo of FF16 is connected to a second input of each of the gates 18 and 19 and through an inverter to a second input of each of the gates 17 and 20. The third input of gate 17 is connected to the output of a flip-flop FF21 receiving on its clock input the signal of 1 kHz from the divider 2 and on its reset input R the signal delivered by a multivibrator 22 the input of which is connected to the output Z of the comparator 14. The third inputs of gates 18, 19 and 20 receive respectively signals of 1 Hz, 32 Hz and 2 Hz delivered by the frequency divider 2. The outputs of gates 18, 19 and 20 are connected to the inputs of an OR gate 23 the output k of which is connected to the clock input of counter 9. The output l of gate 17 is connected to the input U/D of the counter 9. The outputs k and l are the ones indicated in the circuit 5 of FIG. 1.

The memory 13, the flip-flops FF15 and FF16 and the gates 17, 18, 19, 20 and 23 form a sequential circuit delivering the signals k and l at the output of the circuit 5 for controlling the reversible counter 9 and the control circuit 7 of the motor 8. The following truth table shows the logic conditions or states within the memory 13.

| line | Q1 | Qo | S1 | Z | d | e | q1 | qo |
|---|---|---|---|---|---|---|---|---|
| 1 | 0 | 1 | 0 | ϕ | ϕ | ϕ | 0 | 1 |
| 2 | 0 | 1 | 1 | ϕ | ϕ | ϕ | 1 | 1 |
| 3 | 1 | 1 | ϕ | 0 | 0 | ϕ | 1 | 1 |
| 4 | 1 | 1 | ϕ | 1 | 0 | ϕ | 1 | 0 |
| 5 | 1 | 0 | ϕ | ϕ | 0 | ϕ | 1 | 0 |
| 6 | 1 | 0 | 0 | ϕ | 1 | 0 | 1 | 1 |
| 7 | 1 | 1 | 0 | ϕ | ϕ | 0 | 1 | 1 |
| 8 | 1 | 1 | 0 | ϕ | ϕ | 1 | 0 | 1 |

In the preceding truth table the symbol ϕ indicates that the respective logic state can be indifferently 0 or 1. The first line represents the normal motion (one step per second) of the seconds hand. Line 2 shows that the switch selecting the function of correction of the display is closed. This produces as indicated on line 3 the rapid advance of the seconds hand. On line 4, the seconds hand has reached the position 59 of the dial and the comparator 14 delivers a signal of equality Z=1 to the memory. Due to this signal of equality, as indicated on line 5, the motion of the seconds hand is controlled so as to effect two rapid steps forward between the position 59 and the position 1 of the dial and two rapid steps backward between the position 1 and the position 59 of the dial as already indicated previously. Line 6 shows that the delay circuit 12 delivers to the memory a signal d=1 indicating that the time imparted to the user for correcting its timepiece is at its end. This produces as indicated on line 7 the rapid motion of the seconds hand, forward or backward, for making up for the time lost during the correction. On line 8, the comparator 10 delivers a signal of equality e=1 to the memory, indicating that the seconds hand is again in a position of the dial corresponding to the display of the seconds of the real time. From this time, the seconds hand indicates the seconds of the real time by making equal steps forward of one second each. From the truth table it is then possible to calculate the logic relations for the output signals at the terminals l and k of FIG. 2.

For l one obtains:

$$l = Q1 \cdot \overline{Qo} \cdot \tfrac{1}{2}\ \text{Hz}$$

For k one obtains:

$$k = \overline{Q1} \cdot Qo \cdot 1\ \text{Hz} + Q1 \cdot Qo \cdot 32\ \text{Hz} + Q1 \cdot \overline{Qo} \cdot 2\ \text{Hz}.$$

These logic signals l and k are produced by the gates 17, 18, 19, 20 and 23.

From the relation for k it, is to be seen that the rapid motion of the seconds hand is effected by a frequency of 32 Hz, corresponding to 32 steps per second of the seconds hand. The circuits 22 and FF21 provide a synchronisation which ensures that when the seconds hand reaches for the first time the position 59 on the dial the signal l controlling the forward and backward motion of the seconds hand is in a state determining a forward motion of the seconds hand.

FIG. 3 illustrates the relation between the signal of 2 Hz controlling the motion of the seconds hand during its alternate motion between the positions 59 and 1 on the dial and the signal l determining the forward and backward motion of this hand. When Z=1 and due to the synchronisation, the signal l starts always in its logic state 0, permitting at u and v two steps forward of the seconds hand. One second later, the signal l changes to the state 1, permitting at u' and v' two steps backward of the seconds hand, and so on.

The preceding shows that the control circuit 5 is capable of controlling rapid and normal, forward and backward movements of the seconds hand in response to the time base signals and to the actuations of external control elements or by internal control means of the electronic circuit.

It is clear that other functions can be indicated by different movements imposed to the seconds hand, such as: rapid motion of the seconds hand for a determined number n of steps then stopping of the seconds hand on the reached position for a number of seconds equal to the determined number n of steps, and so on. This produces a motion of the seconds hand which is interpreted by the user of the timepiece like an angular displacement of the seconds hand greater than the angle corresponding to one second, every n seconds. It is also possible to impart such a movement in the backward direction or to change periodically or according to a determined function of the time the number n of steps executed every n seconds by the seconds hand for indicating other possible functions of the timepiece.

As an example, FIG. 4 shows a circuit which determines every 4 seconds a rapid advance of 4 steps with a frequency of 32 Hz of the seconds hand. Such a circuit could be utilized for indicating the end of life of the battery as an alternative to the case previously described in which the seconds is definitely stopped in the position 30 of the dial.

The circuit of FIG. 4 comprises an AND gate 24 connected to an electronic selector 25 delivering the output signal k of the circuit 5 for controlling the advance of the seconds hand and of the reversible counter 9. The gate 24 receives from the frequency divider 2 signals having frequencies of ¼ Hz, ½ Hz, 1 Hz, 2 Hz, 4 Hz and 32 Hz and it combines these signals so as to deliver to the input b of the selector 25 the signal b indicated in FIG. 5, comprising a train of 4 pulses of 32 Hz every 4 seconds. When the battery arrives at the end of its life the detector 6 delivers a control signal to the selector 25 which connects its output k to its output terminal b receiving permanently from the gate 24 the corresponding signal b shown in FIG. 5.

It is also clear that the logic circuit 5 or the combination of the circuits 5, 9, 10, 11 and 12 may have a structure of a microprocessor comprising in its memory all the informations relative to the functions of the timepiece which are required for controlling various movements and displacements of the seconds hand in response to the actuation of external control elements.

We claim:

1. A multifunction timepiece having selectable functions comprising:

a dial;

a first motor driving a seconds hand, said seconds hand being capable of performing displacements and movements for identifying selected functions on the dial;

a second motor driving other display elements;

means for generating time base signals;

electronic circuits for delivering the time base signals and control signals to said first and second motors, said second motor being directly controllable by said control signals;

control elements for selecting the functions of the timepiece;

first means for producing data representative of the position of the seconds hand on the dial;

comparator means connected to said first means for producing data, the comparator means being capable of indicating equality between said data and a value of reference;

memory means connected to said control elements and to said comparator means, for producing data concerning desired displacements and movements of said seconds hand in dependence on the selected functions of the timepiece; and logic means connected to the electronic circuits and receiving data from said memory means, for producing respective control signals of the first motor and of the means for producing data representative of the position of the seconds hand, such that the control signal produced in response to said time base signals cause said first motor and the seconds hand driven thereby to perform said displacements and movements for identifying said selected functions.

2. The timepiece according to claim 1, wherein at least part of said control elements are internally located in said electronic circuits.

3. The timepiece according to claim 1, wherein said memory means produces data relative to a stoppage of said seconds hand in a determined position on said dial, said data being produced in response to actuation of at least one of said control elements.

4. The timepiece according to claim 3, wherein at least one of said control elements is an internal element of said electronic circuits for measuring the voltage of a battery feeding power to said timepiece, the internal control element stopping the seconds hand at the end of useful life of said battery, said seconds hand remaining stopped in said determined position until replacement of said battery.

5. The timepiece according to claim 3, wherein said stoppage of said seconds hand temporarily occurs at said determined position of the dial.

6. The timepiece according to claim 1, wherein:

the seconds hand moves a predetermined angular displacement every second when the selected function is the real time of day;

the logic means receives time base signals from said electronic circuits;

said logic means being connected to selector means controlled by at least one of said control elements for delivering a control signal to said first motor, said control signal being a train of a determined number n of pulses having a frequency of repetition greater than 1 Hz, the pulse train appearing every n seconds for controlling the movement of said seconds hand by jumps having an apparent angular displacement greater than the angular displacement occurring when the selected function is the real time of day.

7. The timepiece according to claim 1, wherein said control signals produced by said logic means are pulses having a frequency of repetition greater than 1 Hz.

8. The timepiece according to claim 1, wherein said control signals produced by said logic means cause a backward motion of said seconds hand.

9. The timepiece according to claim 7, wherein said control signals produced by said logic means cause a backward motion of said seconds hand.

10. The timepiece according to claim 1, further comprising:

time delay means connected to said memory means, for generating a signal to the memory means after a period of time;

the seconds hand normally being driven one step of angular displacement positional change per second to indicate the seconds of the real time of day by a first control signal pulse, having a 1 Hz frequency of repetition;

a second control signal, generated by said logic means in response to actuation of at least one of said control elements, said second control signal having pulses of a greater than 1 Hz first frequency of repetition for rapidly driving the seconds hand from its normal position indicating the seconds of the real time to a first determined, fixed position on the dial;

a third control signal generated in response to an equality signal delivered by said comparator means when the seconds hand reaches the first determined position, said third signal having pulses of a second frequency of repetition greater than 1 Hz, but different from said first frequency of repetition, for causing said seconds hand to move with more than one step per second to a second determined, fixed position on the dial;

such that said memory means delivers to said logic means signals which periodically cause the forward and backward alternate motion of the seconds hand between said first and second determined, fixed positions until said delay means delivers the delay signal, said delay signal causing the seconds hand to move rapidly to its normal position corresponding to the display of the seconds of the real time.

11. The timepiece according to claim 6, wherein said logic means produces control signals causing movements of the seconds hand which are different from one displacement per second.

12. The timepiece according to claim 1, wherein said means for producing data representative of the position of the seconds hand, said comparator means, said memory means and said logic means are parts of a microprocessor.

* * * * *